US007032417B2

(12) United States Patent
Toulis et al.

(10) Patent No.: US 7,032,417 B2
(45) Date of Patent: Apr. 25, 2006

(54) LOCK MECHANISM

(75) Inventors: Christodoulos Toulis, Wellington (NZ); Peter Gordon Sclater, Wellington (NZ)

(73) Assignee: Assa Abloy Financial Services AB, Stockholm (SE)

( * ) Notice: Subject to any disclaimer, the term of this patent is extended or adjusted under 35 U.S.C. 154(b) by 95 days.

(21) Appl. No.: 10/661,325

(22) Filed: Sep. 11, 2003

(65) Prior Publication Data

US 2004/0050119 A1 Mar. 18, 2004

(30) Foreign Application Priority Data

Sep. 12, 2002 (NZ) ..... 521338

(51) Int. Cl.
*E05B 65/08* (2006.01)

(52) U.S. Cl. ..... 70/97; 70/99; 70/100; 292/DIG. 46

(58) Field of Classification Search ..... 70/96–100, 70/107, 134, 137; 292/DIG. 46, 49, 132, 292/197, 224, 241
See application file for complete search history.

(56) References Cited

U.S. PATENT DOCUMENTS 720,349 A * 2/1903 Howard ..... 70/97
2,736,185 A * 2/1956 Collar ..... 70/100
2,810,284 A * 10/1957 Wartian ..... 70/99
2,821,422 A * 1/1958 Rainman ..... 292/113
2,917,915 A * 12/1959 Rainman ..... 70/100
3,025,693 A * 3/1962 Braginetz ..... 70/100
3,040,555 A * 6/1962 Wartian ..... 70/97
3,177,687 A * 4/1965 Tucker ..... 70/97
4,050,272 A * 9/1977 Tanaka ..... 70/100
5,906,403 A * 5/1999 Bestler et al. ..... 292/26
6,327,879 B1 * 12/2001 Malsom ..... 70/97
6,502,435 B1 * 1/2003 Watts et al. ..... 70/95
6,748,773 B1 * 6/2004 Alchin et al. ..... 70/99

* cited by examiner

*Primary Examiner*—Suzanne Dino Barrett
(74) *Attorney, Agent, or Firm*—Blakely Sokoloff Taylor & Zafman

(57) ABSTRACT

A lock mechanism primarily intended for a sliding door or window application. The lock mechanism includes a lock body (10) with a lock beak (21) rotatably mounted therewith and biased by a bias element (23) to a first position. The lock beak (21) is co-operable with a hook (20) of a strike (13) upon the hook engaging in the body whereby the lock beak (21) rotates to a second position against the bias of biasing element (23). Operating members (27 and 28) within the lock body (10) are operable by external actuating elements such that the operating members can be independently operated to cause the lock beak (21) to move from said first position to said second position and one of the operating members to retain the lock beak in said first position.

26 Claims, 11 Drawing Sheets

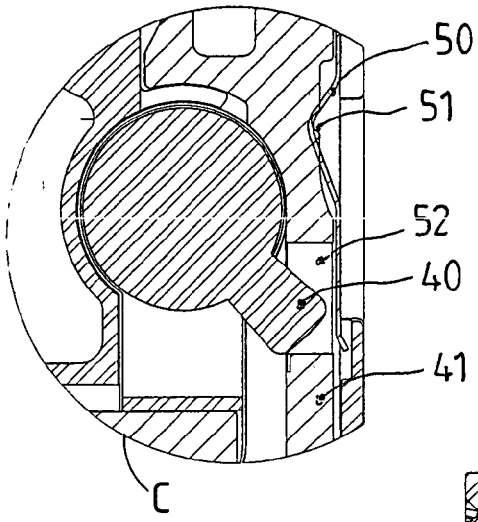
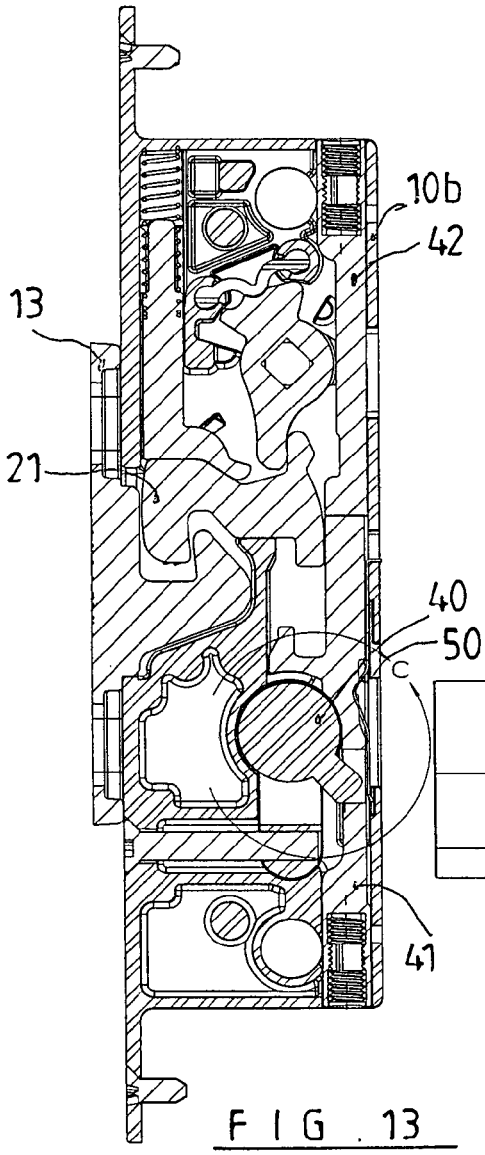
FIG. 13
FIG. 12
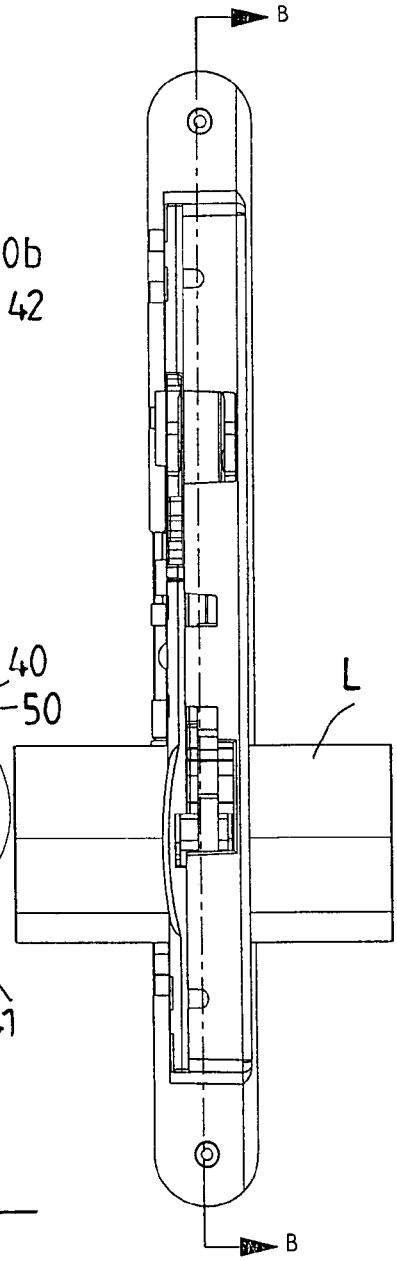

LOCK MECHANISM

BACKGROUND OF THE INVENTION

This invention relates to a lock mechanism. The lock is primarily intended for a sliding door or window application.

In the following disclosure the door lock according to the invention will be described in the context of a mortice lock. However, it will be apparent to those skilled in the art that the lock mechanism in one or more of its possible forms could also be incorporated in a housing intended for rim or surface mounting. Consequently while the following description will describe a mortice lock any reference to lock housing or lock body should be read in the context of the housing or body being suitable for a mortice lock mounting i.e. within the door or a rim/surface mounting application.

Mortice locks for e.g. sliding doors provide a number of functions such as simple latching and unlatching of the door, so called day latching and deadlocking. To achieve these functions one lever is provided for latching, another lever or the like for day latching and a key cylinder for deadlocking. Visually the lock furniture associated with the lock takes on a "very busy" appearance resulting from the two levers and key cylinder. This also tends to restrict the size of the levers which can be used, otherwise the levers can be difficult to access and use. Thus, there are issues of appearance and user friendliness associated with existing locks. While these are manifested in the externally visible lock furniture the construction and arrangement of the lock mechanism dictates the number and/or type of external levers, snib etc. and position of the key cylinder.

SUMMARY OF THE INVENTION

It is an object of the present invention to provide a lock which requires only a single actuation lever on both interior and exterior sides of a closure with which the lock is associated in order to achieve latching and day latching functions.

Broadly according to one aspect of the invention there is provided a lock mechanism including a lock body, a lock beak rotatably mounted within the lock body, a biasing device which bias the lock beak to a first position, a strike having a hook, the hook co-operable with the lock beak when the hook is engaged in the body, and the lock beak is in said first position, operating members within the lock body operable by external actuating means, the operating members being operatively mounted such that they can be independently operated to cause the lock beak to rotatably move against the bias of the biasing device from said first position to a second position to remove the engagement between the hook and lock beak and one said operating member being operable to retain the lock beak in said first position.

Preferably the lock further includes means to prevent the other of the operating members from being operable to retain a lock beak in said first position.

According to one form of the invention the lock includes a slide member operable by a lock cylinder to effect a deadlocking function.

Preferably the slide member provides a mounting for at least one shoot bolt.

The slide member preferably includes a first engagement means which is engageable with the lock beak to cause deadlocking of the lock beak in the first position. Preferably the slide member includes a second engagement means which is engageable with at least one of the operating members to prevent operation thereof by the external actuating means.

The lock preferably further includes a retention spring means which is engageable with a cam of a lock cylinder to retain the cam when in the position which corresponds to the slide member having been moved by the cam to a deadlocked position.

Preferably the retention spring additionally applies a detent to the slide member when the slide member is in the non-deadlocking position.

BRIEF DESCRIPTION OF THE DRAWINGS

In the following more detailed description of the invention reference will be made to the accompanying drawings in which:

FIG. 12 is a side elevation view with the lock in the configuration shown in FIG. 11, and FIG. 13 is a cross-section view taken on line B—B of FIG. 12.

DETAILED DESCRIPTION

Figure 1:
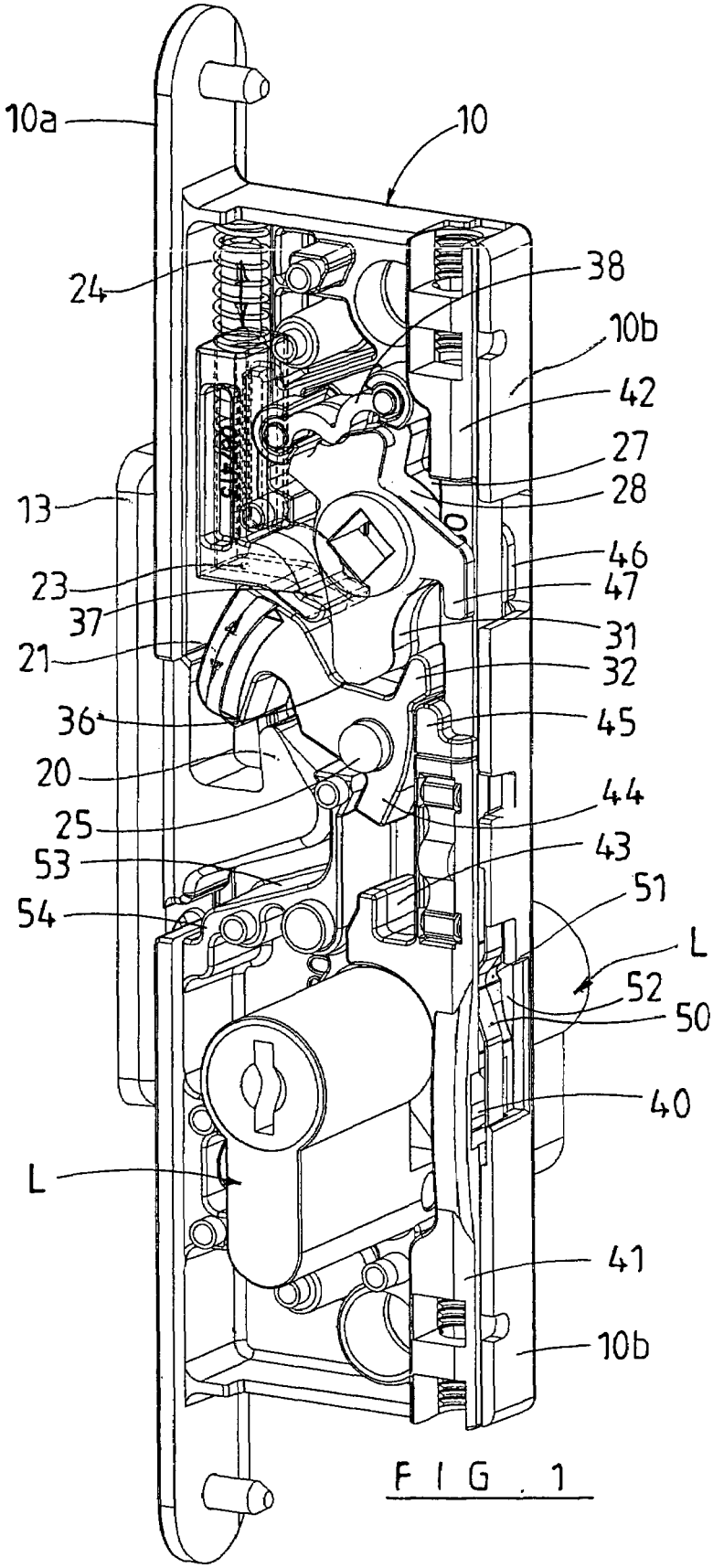
FIG. 1 is a perspective view of the lock with a cover plate of the lock body/housing removed to show the componentry of the lock mechanism, the lock being shown in the unlatched position but in juxtaposition with a strike.
Figure 2:
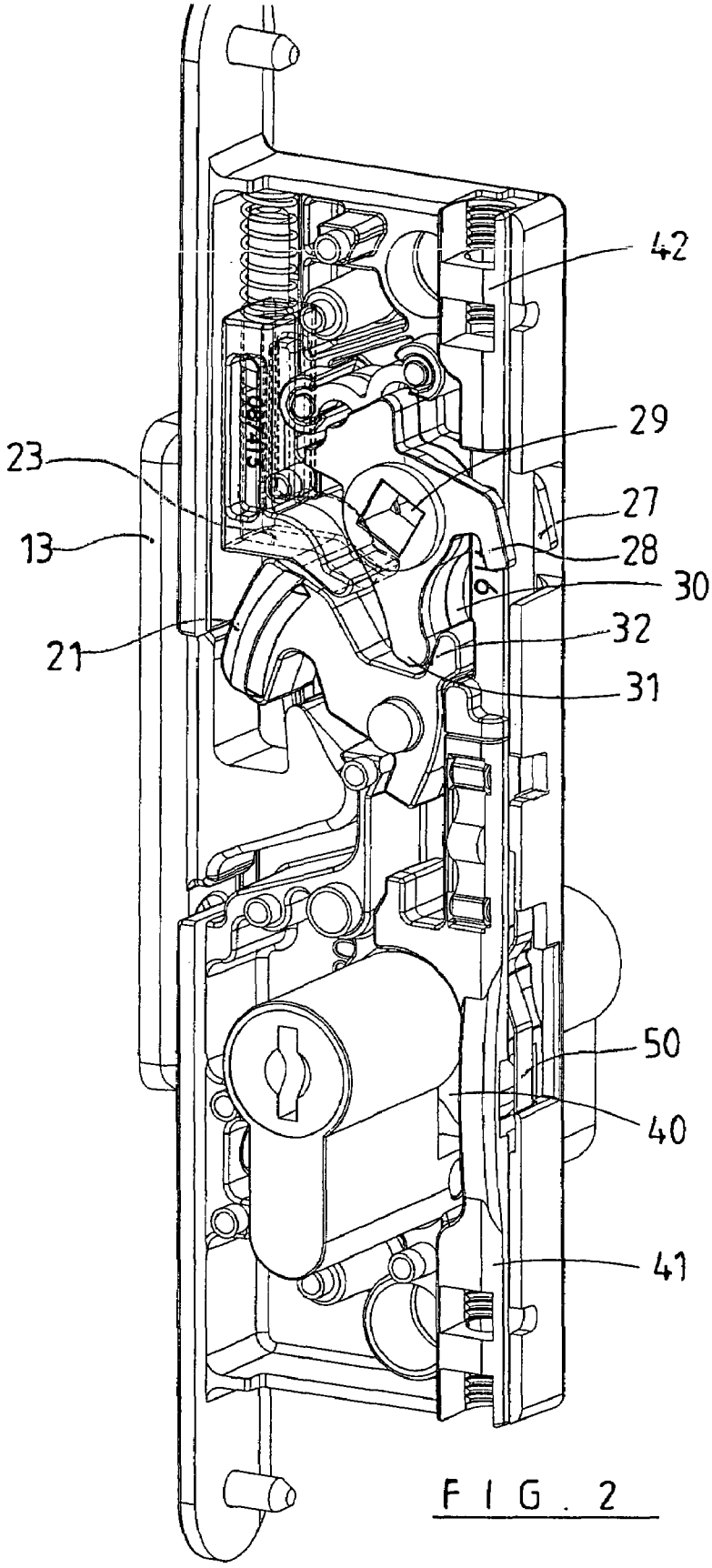
FIG. 2 is a view similar to FIG. 1 but with the lock mechanism in its initial operation of movement of a locking beak interengaging with the strike.

The lock includes a lock body or housing 10 into which the various components of the locking mechanism (as hereinafter described) are fitted. The housing 10 is closed by a cover which is not shown in the drawings so that the internal workings of the lock can be shown. The housing 10 further includes a front edge faceplate 10*a* and a rear wall 10*b*.

Figure 3:
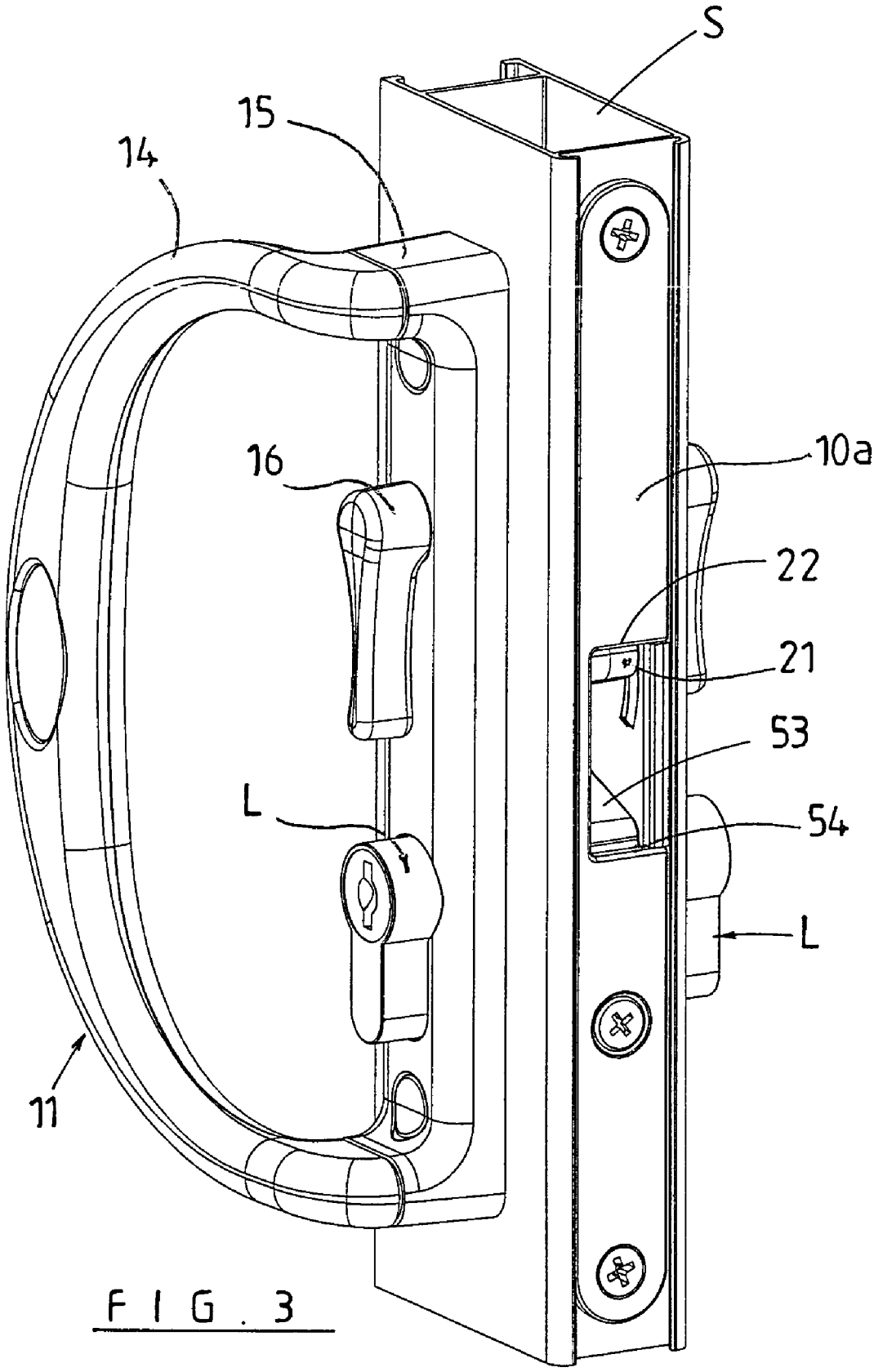
FIG. 3 is a perspective view of part of the section of a sliding door with the lock mechanism according to the present invention mortice mounted therein and associated with internal and external latch furniture.
Figure 4:
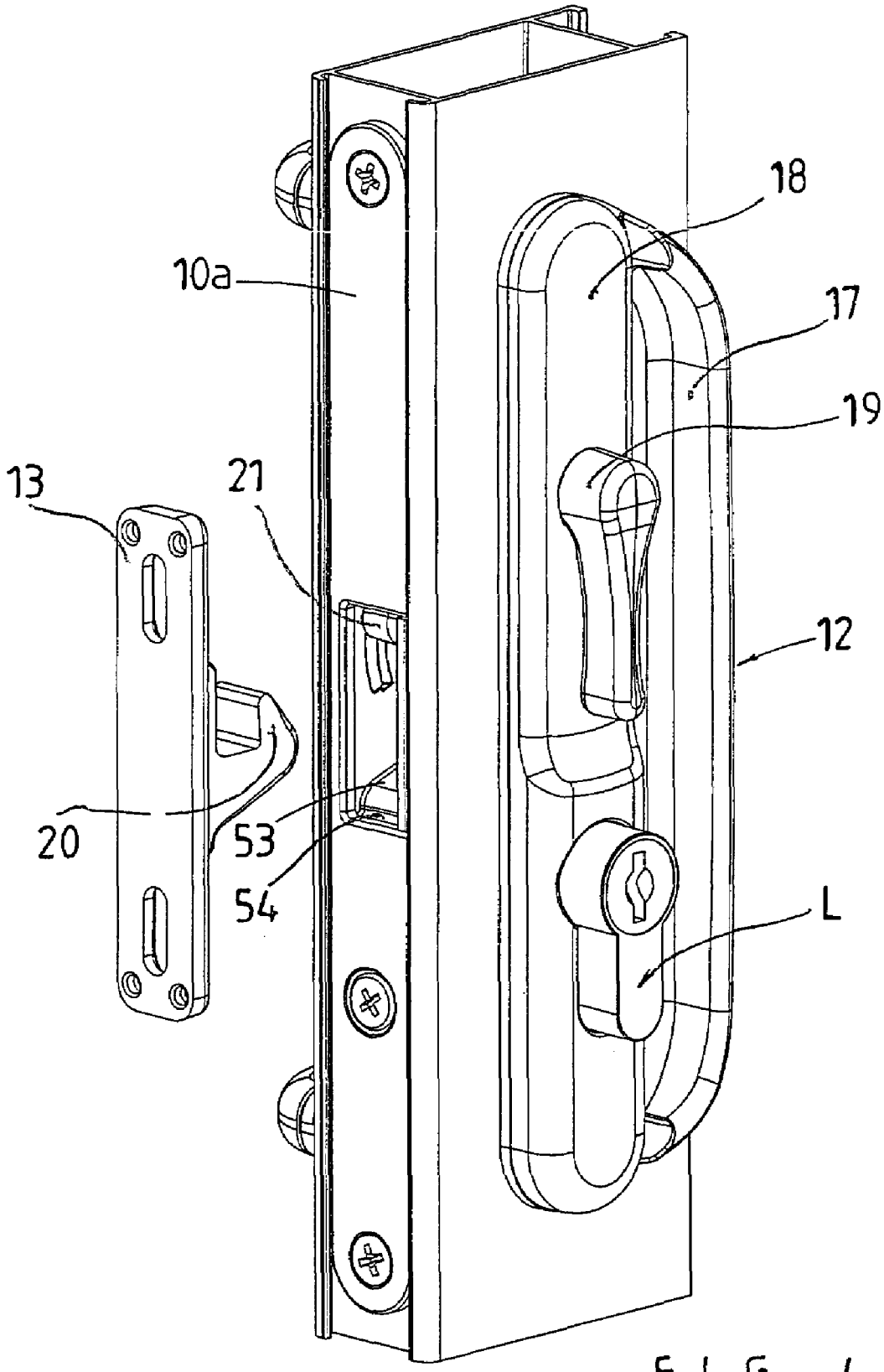
FIG. 4 is a reverse view of the arrangement shown in FIG. 3 but further incorporating the strike.
Figure 5:
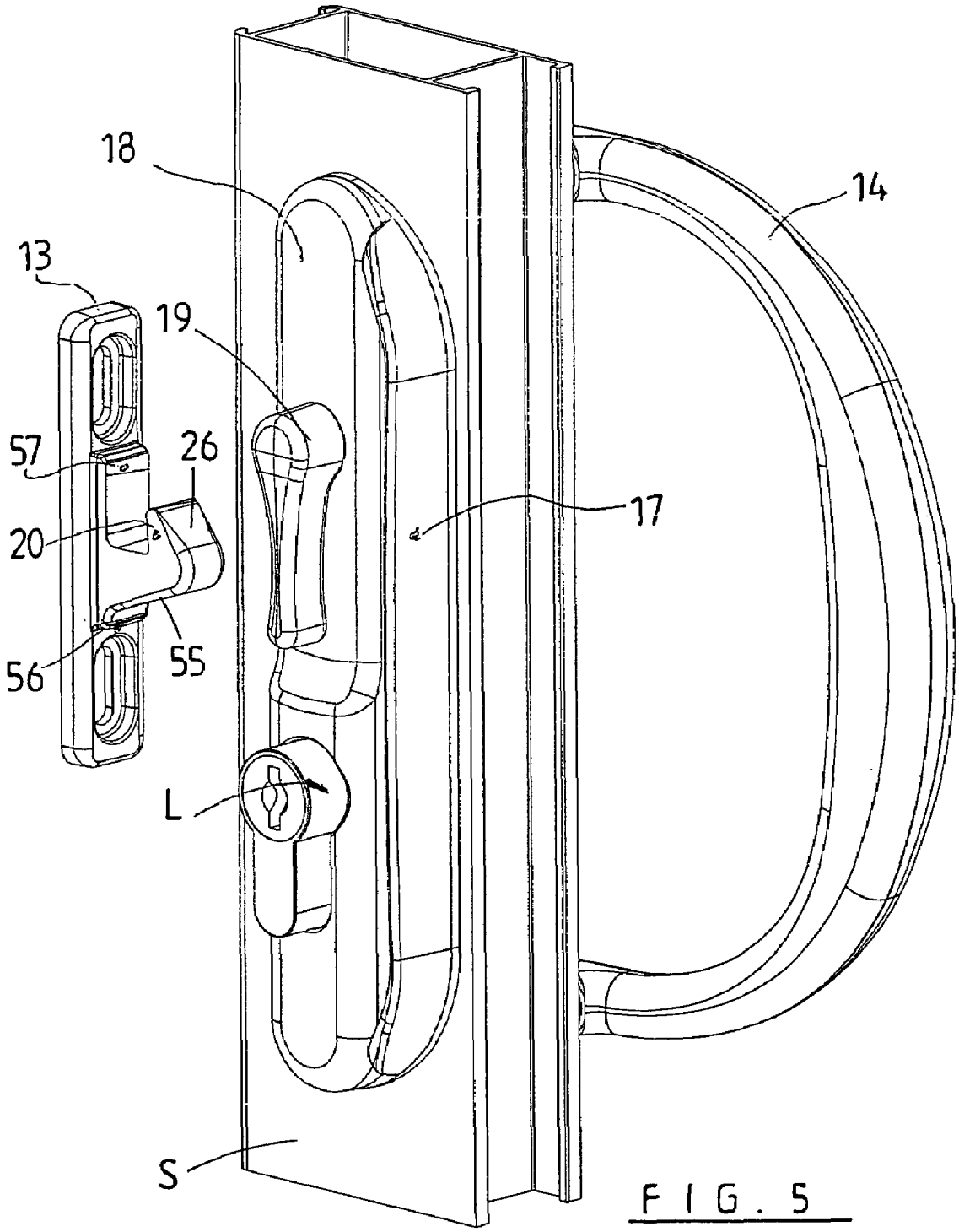
FIG. 5 is a further perspective view of the sliding door section with furniture and strike but from a viewpoint different to that of FIG. 4.

In a mortice application the housing 10 is engaged through or in a generally rectangular shape opening formed in the section S of the door. The housing 10 therefore locates within the internal cavity of the door section S with the faceplate 10*a* fastened to an exterior surface of the side edge of the section S (see FIG. 3).

The lock is, as normal, associated with furniture components. On the interior side of the door the furniture component comprises a D-handle 14 with a mounting escutcheon 15. Mounted with the escutcheon 15 is a latching lever 16. Extending through an opening in escutcheon 15 is one end of a double lock cylinder L.

On the exterior side of the section S there is provided a pull 17 with associated mounting escutcheon 18. Extending through an opening in escutcheon 18 is the other end of the lock cylinder L. A latching lever 19 is also mounted with the escutcheon 18.

The lock beak 21 of the lock locates adjacent an opening 22 in the faceplate 10*a*. A hook 20 of strike 13 is engageable through opening 22 as can be seen for example in FIG. 1.

The lock beak 21 is pivotally mounted about an axis established by a pair of stub axles 25 which are journaled in suitable bearing areas (not shown) of the housing 10 and cover plate. A sliding foot 23 engages with the lock beak 21 adjacent the hooked end thereof. The sliding foot 23 is biased by a compression spring 24.

The lock is therefore self-latching. When the door is moved into the closed position the hook 20 of the strike 13 engages through opening 22 and contacts the lock beak 21. The ramp surface 26 of the strike hook 20 engages with the hook position of lock beak 21 causing the lock beak to ride upwardly about the axis of sub-axles 25 and against the action of the spring biased sliding foot 23. Consequently, once the lock beak 21 clears the ramp 26 of the hook strike 20 the spring 24 drives the sliding foot 23 downwardly thereby acting against the lock beak 21 to latch it on to the lock strike 20.

Figure 11:
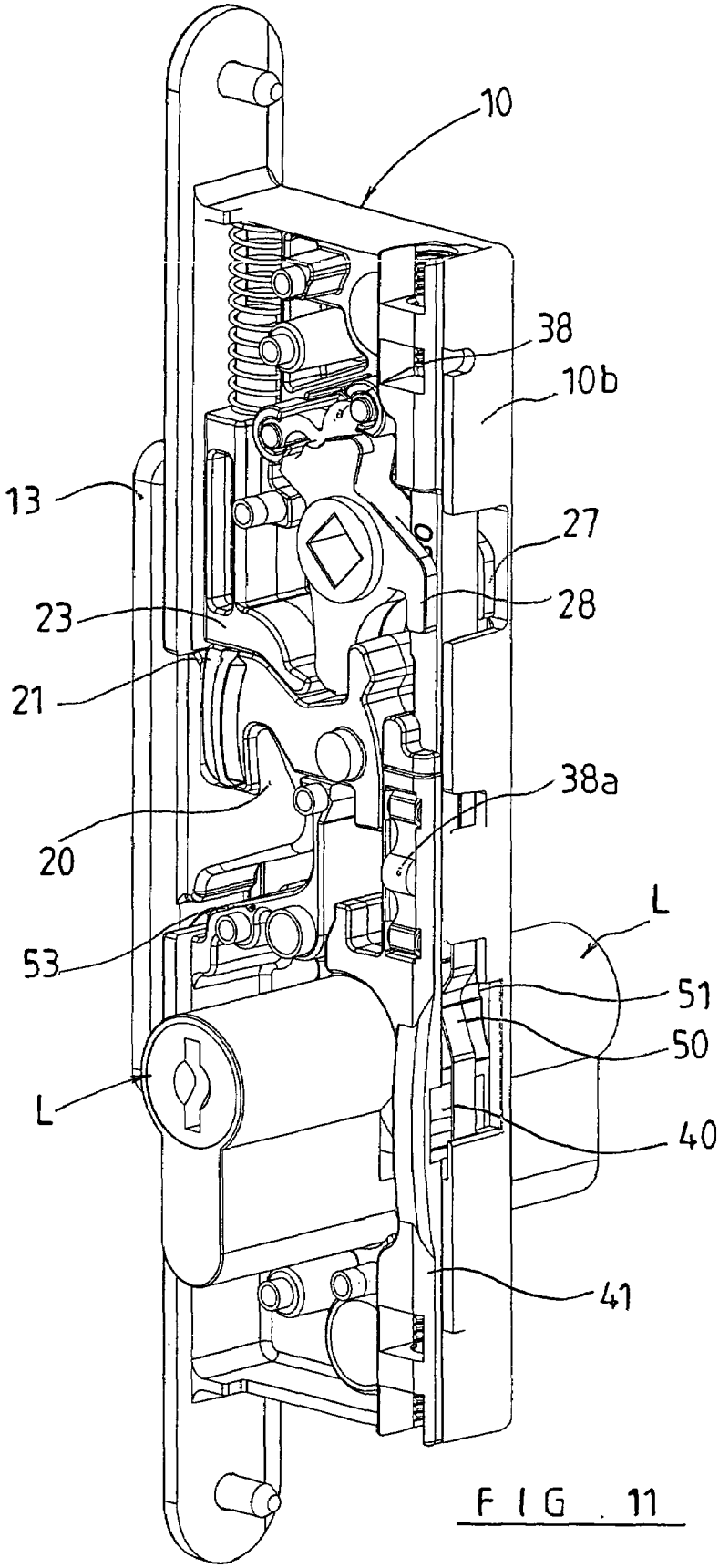
FIG. 11 is a view similar to FIG. 8 but showing the top and bottom shot bolts in the unlocked position.

FIG. 1 shows the lock beak 21 having cleared the ramp 26 and being acted upon by the sliding foot so that ultimately the sliding foot 23 will ensure that the lock beak 21 engages with the strike hook 20 as shown, for example, in FIG. 11.

Figure 6:
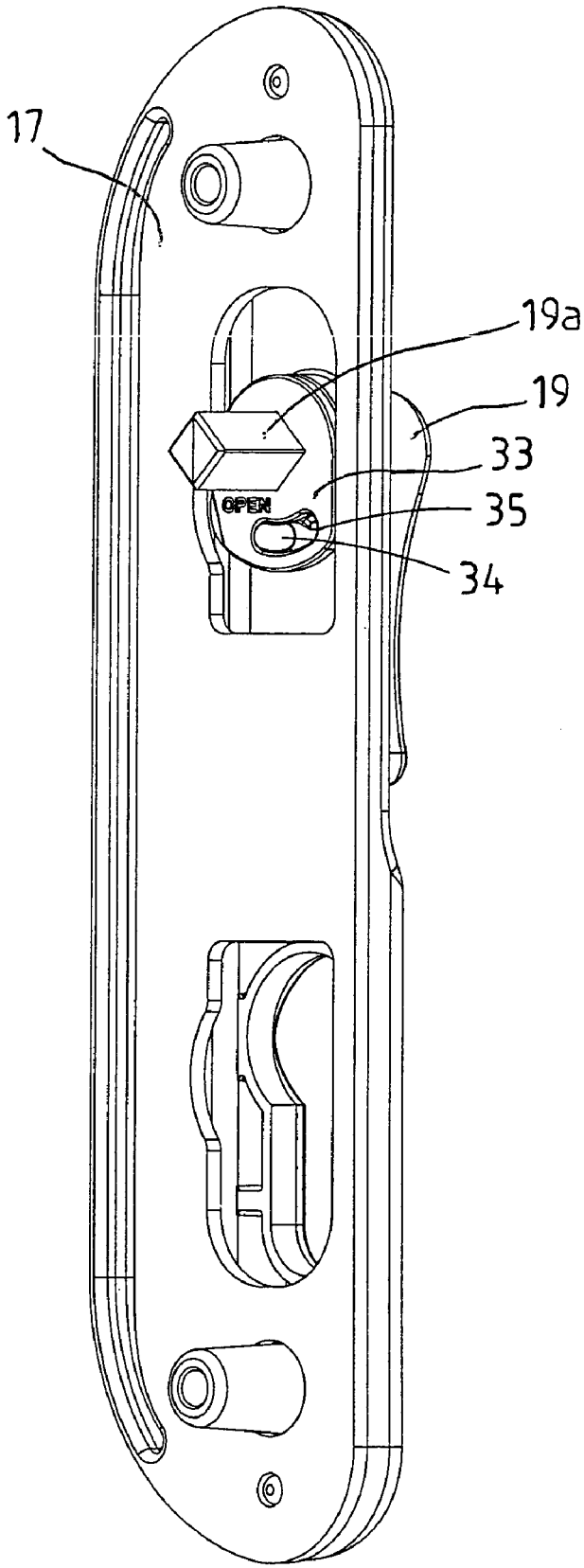
FIG. 6 is an inside face view of an item of lock furniture for use with the lock according to the present invention.

The lock can be unlatched using both interior and exterior latching levers 16 and 19 respectively. Each of the latching levers 16 and 19 has a square drive portion e.g. the drive portion 19*a* of lever 19 (see FIG. 6) which extends into cam 28 which is rotatably mounted within the housing 10. For example, referring to FIG. 1 the square drive 19*a* of exterior lever 19 will engage within square section opening 29 of the cam 28. Likewise a square drive portion of the interior latching lever 16 will co-operatively engage with cam 27.

The latching levers 16 and 19 can thus be rotated individually to act on the lock beak 21. This is achieved by an arm 30 or 31 of the respective cams 27 and 28 acting against an abutment portion 32 of the lock beak 21. The action of rotating the latching lever therefore results in the lock beak rising against the sliding foot 23 and out of engagement with the strike 13. Once the strike 13 has moved out of the housing 10 and the latching lever 16 or 19 is released the lock beak 21 will return to its horizontal or rest position under the action of the sliding foot 23.

The lock can be latched internally by a manual operation of the internal latching lever 16. The external latching lever 19 drives a handing disc 33 (see FIG. 6) with its square drive 19*a* which will not allow the lock to be day latched from the outside.

The handing disc 33 is housed in the exterior escutcheon 18. A lug 34 formed on the inside of the escutcheon 18 engages in an arcuate slot 35 in the handing disc 33. The lug 34 abuts one end of the slot 35 thus preventing the latching lever 19 being moved in a direction would be necessary in order to day latch the mechanism. The handling disc thus prevents the lock being placed into the day latched condition from the outside of the door only. This overcomes a problem which could arise if the lock were able to accidentally be day latched as a user exits the door thereby preventing other users from being able to open the door from the inside.

Figure 7:
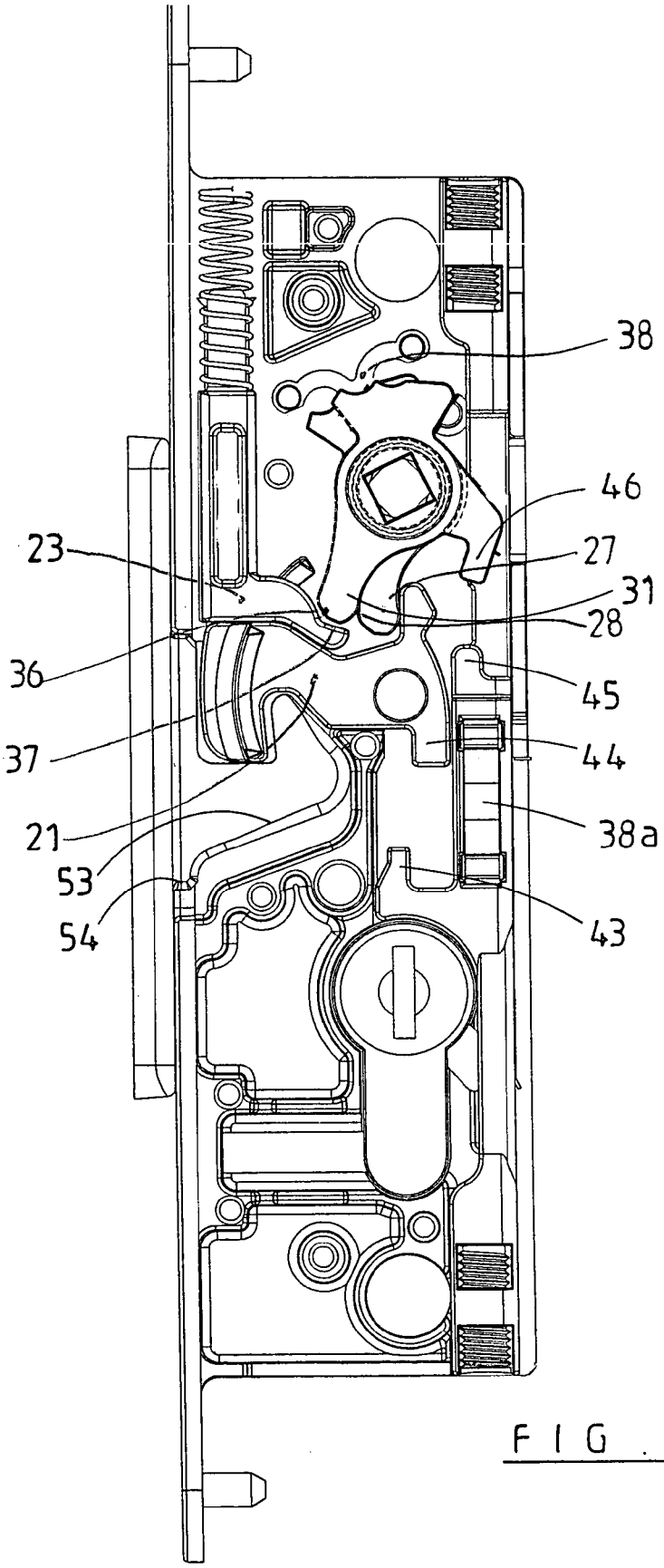
FIG. 7 is an elevation view of the arrangement shown in FIGS. 1 and 3 but with the lock mechanism moved to the day latched position where the lock beak has engaged with the strike and the lock beak is engaged by a sliding foot to prevent the lock beak from being actuated.

The lock is manually latched when the interior latching lever 16 rotates one of the cams 27/28 so that the surface 36 at the end of the arm 31 is adjacent or in contact with surface 37 of the sliding foot 23 (see FIG. 7). The cam 27 or 28 (cam 27 in the configuration shown in FIG. 7) is held in place by the detent spring 38. Because of the juxtaposition of the end 36 of arm 31, as shown in FIG. 7, with the surface 37, the sliding foot 23 cannot slide against the bias of the compression spring 24 and thereby release the lock beak 21.

The lock can be deadlocked via the lock cylinder L from both interior and exterior keys. The key activates cam 40 of the lock cylinder L. This cam 40 acts upon a bottom shoot bolt 41 and a top shoot bolt 42 which are joined and act as one. In effect there is a single slide member which forms shoot bolts 41 and 42. The cam 40 therefore "lifts" the shoot bolts 41/42 so that a projection 43 thereof (see FIG. 8) engages with a downwardly projecting portion 44 of the lock beak 21. Similarly a projection 45 of the shoot bolt 41/42 engages with hook shaped portions 46 and 47 of the respective cams 27 and 28. This prevents the lock being unlatched via the latching levers 16 and 19.

The shoot bolt 41/42 can also be used to activate and deactivate remote locks (not shown) in the door for added security. Alternatively, the top shoot bolt 41 can be coupled to a rod which projects through the top of the door and into a keep in the top frame member of the door surround.

When cam 40 of the lock cylinder L is rotated, for deadlocking, the cam 40 rides against a cam retention leaf spring 50 which is mounted with the sidewall 10*b* of the housing 10 in the vicinity of an opening in the sidewall 10*b*. The cam retention leaf spring 50 over centres the cam 40 and thus prevents the shoot bolts 41/42 from being manipulated to un-deadbolt the lock.

Figure 8:
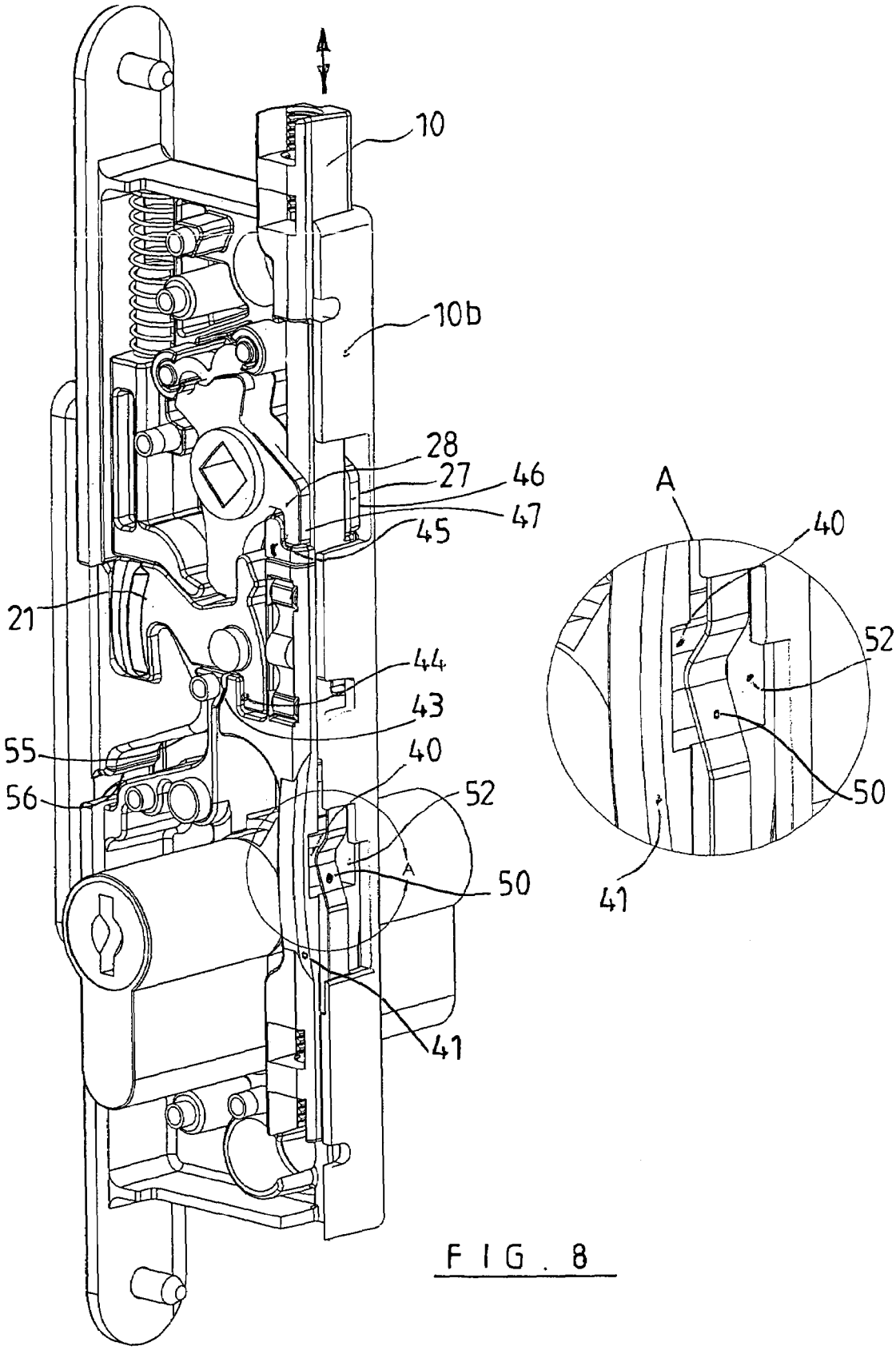
FIG. 8 is a perspective view of the lock mechanism as shown in FIG. 7 but with the mechanism having advanced further in its latching operation.
Figure 10:
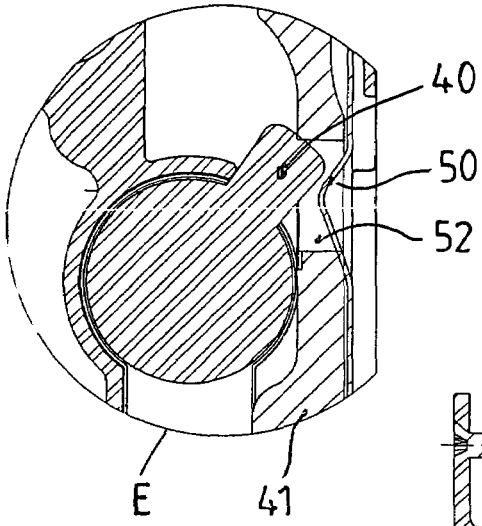
FIG. 10 is a section on line D—D of FIG. 9.
Figure 10:
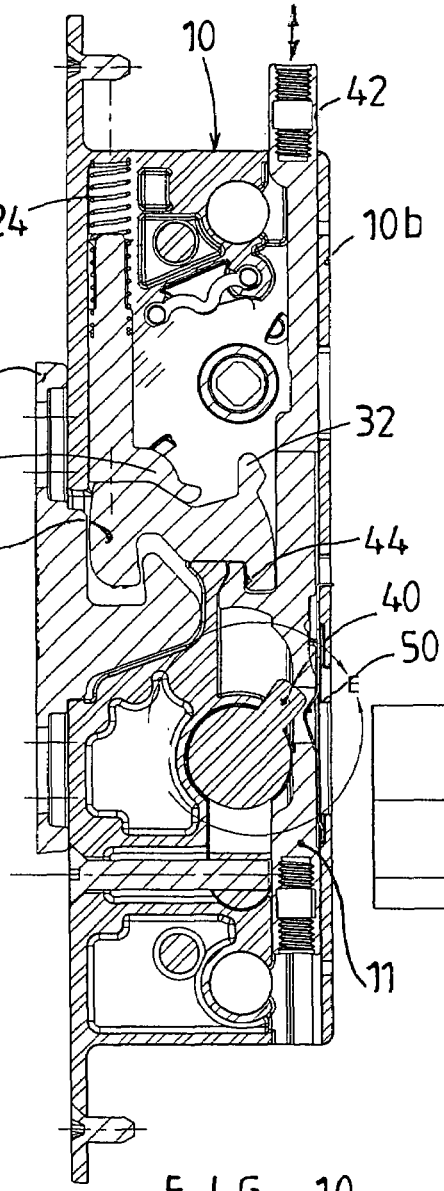
Figure 9:
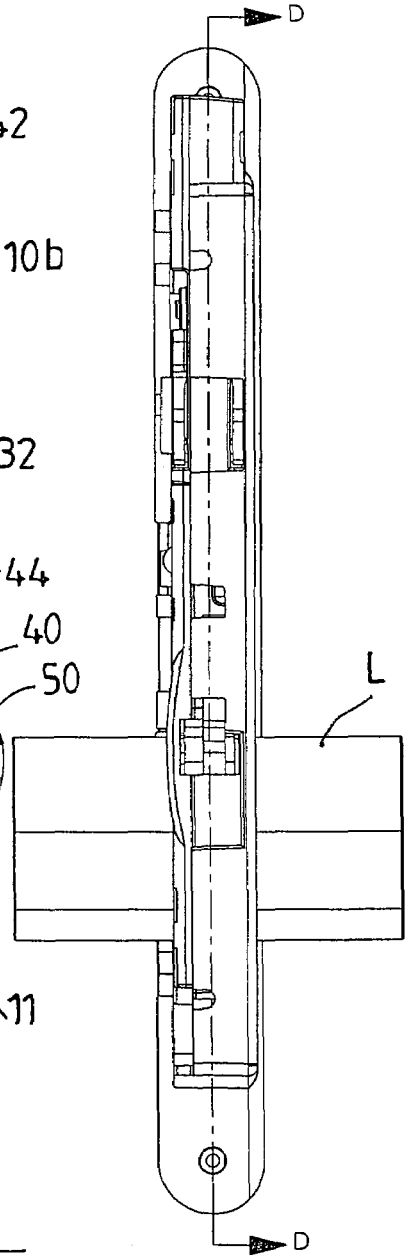
FIG. 9 is a side elevation view of the lock according to the present invention.

The cam retention leaf spring 50 also acts as an additional detent against shoot bolt 41 in cavity 51 for the unlocked position (see FIG. 11) and in cavity 52 for the locked position (see FIG. 8). As will be appreciated all of these functions are thus accomplished with one component namely the combined shoot bolts 41/42.

Detent springs 38*a* also provide a detent action with shoot bolt 41.

The lock cannot be lifted off the strike 13. The lock housing 10 has a ramp surface 53 and associated step 54 (adjacent the opening 22) which can act against the underside 55 and associated step 56 of the strike 20 in the event that an attempt is made to try and lift the lock off the strike. Furthermore, the strike has an abutment surface 57 which engages with an edge of a cover plate 10*a* at opening 22. These features combine to prevent any vertical lift of the door in an effort to unlatch the lock.

The lock according to the present invention provides an effective yet straightforward lock construction which provides a number of desirable features. These include:—

An internal lever 16 which has a combined action of both opening and day latching the lock mechanism.

A spring element 50 which achieves functions which are normally achieved by separate components in known lock constructions. The spring 50 provides a deadlocked condition of the slide element (forming the top and bottom shoot bolts 41/42) via interaction of the cylinder cam 40. It also provides a detented bias of the slide 41/42 in both the deadlocked and un-deadlocked state.

The handing disc 33 prevents the external lever 19 from activating the day latch state.

An anti-lift feature incorporated into the design of the strike 13.

The lock of the present invention thus enables use of a single actuation lever and cylinder on both the interior and exterior sides of the closure with which the lock is associated. This provides advantages such as improved visual appearance of lock furniture and the use of actuation levers of a size that are easier to use. It is also believed that the lock design will be such that it is more intuitive to use from a dwellers point of view. From a manufacturers viewpoint it is believed there will be reduced costs of manufacture by reducing the number of levers that need to be manufactured.

Other features of the lock will be apparent to those skilled in the art. Also it will be apparent to those skilled in the art that the lock mechanism as described herein is open to modification within the scope of the invention.

What is claimed is:

1. An apparatus comprising:

a lock mechanism including a lock body, a lock beak rotatably mounted within the lock body, a biasing device which bias the lock beak to a first position, a strike having a hook, the hook co-operable with the lock beak when the hook is engaged in the body, and the lock beak is in said first position, operating members within the lock body operable by external actuating means, the operating members being operatively mounted such that they can be independently operated to cause the lock beak to rotatably move against the bias of the biasing device from said first position to a second position to remove the engagement between the hook and lock beak and one said operating member being operable to retain the lock beak in said first position.

2. The apparatus as claimed in claim 1, the lock mechanism further including means to prevent the other of the operating members from being operable to retain a lock beak in said first position.

3. A lock mechanism as claimed in claim 1 wherein the biasing device is a sliding foot engaged with a part of the lock beak and a spring which applies a biasing force to the sliding foot.

4. A lock mechanism as claimed in claim 1 wherein the lock beak has a hook position that inter-engages within the lock body with the hook of the strike.

5. A lock mechanism as claimed in claim 3 wherein the lock beak has a hook position against which the sliding foot engages, and the hook portion inter-engages within the lock body with the hook of the strike.

6. A lock mechanism as claimed in claim 1 wherein each operating member has an arm which engages with an abutment portion of the lock beak, operation of the operating member by a said external actuating means causing movement of the arm to occur and resultant movement of the lock beak from the first position.

7. A lock mechanism as claimed in claim 3 wherein the one said operating member retains the hook beak in said first position by the arm thereof engaging the sliding foot to prevent movement thereof.

8. A lock mechanism as claimed in claim 7 wherein the slide member has a mounting for connection to the slide member of a shoot bolt.

9. A lock mechanism as claimed in claim 6 further including a detent spring engaged with the operating member.

10. A lock mechanism as claimed in claim 1 wherein the lock body includes a ramp and a ramp step adjacent an opening in the lock body through which the hook engages, said hook including a hook surface and hook step which are inter-engageable with said ramp and ramp step, the positioning of the ramp, ramp step, hook surface and hook step being such that engagement there between occurs before separation of the lock beak when in the first position and the strike hook.

11. A lock mechanism as claimed in claim 10 wherein the strike includes an abutment surface engageable with an edge of the opening in the lock body.

12. A lock mechanism as claimed in claim 1 wherein one external actuating member is coupled to a handing disc, the handing disc has an elongate slot to insert a lug of an escutcheon, to which the one external actuating member is coupled, the lug being engageable at one end of the slot to restrict movement of the one external actuating member.

13. An apparatus comprising: a lock mechanism including a lock body, a lock beak rotatably mounted within the lock body and biased by bias means to a first position, the lock beak being co-operable with a hook of a strike as the hook engages in the body whereby the lock beak rotates to a second position against the bias of the biasing means, and operating members within the lock body operable by external actuating means whereby the operating members can be independently operated to cause the lock beak to move from said first position to said second position and one said operating member to retain the lock beak in said first position, and a slide member operable by a lock cylinder to effect a deadlocking function.

14. The apparatus as claimed in claim 13 wherein the slide member provides a mounting for at least one shoot bolt.

15. The apparatus as claimed in claim 14 wherein the slide member includes a first engagement means which is engageable with the lock beak to cause deadlocking of the lock beak in the first position.

16. The apparatus as claimed in claim 13 wherein the slide member includes a first engagement means which is engageable with the lock beak to cause deadlocking of the lock beak in the first position.

17. The apparatus as claimed in claim 15 wherein the slide member further includes a second engagement means which is engageable with at least one of the operating members to prevent operation thereof by the external actuating means.

18. The apparatus as claimed in claim 13 further including a retention spring means which is engageable with a cam of a lock cylinder to retain the cam when in the position which corresponds to the slide member having been moved by the cam to a deadlocked position.

19. The apparatus as claimed in claim 18 wherein the retention spring additionally applies a detent to the slide member when the slide member is in the non-deadlocking position.

20. The apparatus as claimed in claim 14 further including a retention spring means which is engageable with a cam of a lock cylinder to retain the cam when in the position which corresponds to the slide member having been moved by the cam to a deadlocked position.

21. The apparatus as claimed in claim 20 wherein the retention spring additionally applies a detent to the slide member when the slide member is in the non-deadlocking position.

22. The apparatus as claimed in claim 16 further including a retention spring means which is engageable with a cam of lock cylinder to retain the cam when in the position which corresponds to the slide member having been moved by the cam to a deadlocked position said retention spring additionally applying a detent to the slide member when the slide member is in the non-deadlocking position.

23. An apparatus comprising:

a lock mechanism including a lock body, a lock beak rotatably mounted within the lock body and biased by bias means to a first position, the lock beak being co-operable with a hook of a strike as the hook engages in the body whereby the lock beak rotates to a second position against the bias of the biasing means, and operating members within the lock body operable by external actuating means whereby the operating members can be independently operated to cause the lock beak to move from said first position to said second position and one said operating member to retain the lock beak in said first position, means to prevent the other of the operating members from being operable to retain the lock beak in said first position and a slide member operable by a lock cylinder to effect a deadlocking function.

24. The apparatus as claimed in claim 23 wherein the slide member provides a mounting for at least one shoot bolt.

25. The apparatus as claimed in claim 23 wherein the slide member includes a first engagement means which is engageable with the lock beak to cause deadlocking of the lock beak in the first position.

26. The apparatus as claimed in claim 25 wherein the slide member further includes a second engagement means which is engageable with at least one of the operating members to prevent operation thereof by the external actuating means.

* * * * *